US010201205B2

(12) United States Patent
Moore

(10) Patent No.: US 10,201,205 B2
(45) Date of Patent: Feb. 12, 2019

(54) HELMET LINER

(71) Applicant: MOOR INNOVATIVE TECHNOLOGIES, LLC, Olympia, WA (US)

(72) Inventor: Timothy P. Moore, Olympia, WA (US)

(73) Assignee: Moor Innovative Technologies, LLC, Olympia, WA (US)

( * ) Notice: Subject to any disclaimer, the term of this patent is extended or adjusted under 35 U.S.C. 154(b) by 309 days.

(21) Appl. No.: 13/838,255

(22) Filed: Mar. 15, 2013

(65) Prior Publication Data

US 2014/0259312 A1 Sep. 18, 2014

(51) Int. Cl.
*A42B 3/12* (2006.01)

(52) U.S. Cl.
CPC ..... *A42B 3/121* (2013.01); *A42B 3/12* (2013.01)

(58) Field of Classification Search
CPC .. A42B 1/08; A42B 3/12; A42B 3/121; A42B 3/125; A42B 3/128; A42B 3/04; A42B 3/069; A42B 3/127; A41D 13/015; A41D 13/0506; A41D 13/0512; A41D 13/05; A41D 13/0543; A41D 13/06; A61F 2007/0002; A61F 2007/0008; A61F 2007/0257; A61F 2007/0268; A61F 7/08; A61F 5/05883; A61F 5/05891
USPC ..... 2/411, 413, 414, 425, 267
See application file for complete search history.

(56) References Cited

U.S. PATENT DOCUMENTS

| | | | | |
|---|---|---|---|---|
| 2,493,363 | A * | 1/1950 | Sapp | 34/95.1 |
| 4,023,213 | A * | 5/1977 | Rovani | 2/413 |
| D267,287 | S * | 12/1982 | Gooding | D29/122 |
| 4,854,319 | A * | 8/1989 | Tobin | 607/109 |
| 5,035,009 | A * | 7/1991 | Wingo, Jr. | A42B 3/121 2/414 |
| D364,487 | S * | 11/1995 | Tutton | D29/122 |
| 6,391,935 | B1 * | 5/2002 | Hager | C08G 18/283 521/157 |
| D617,503 | S * | 6/2010 | Szalkowski | D29/122 |
| 8,039,078 | B2 * | 10/2011 | Moore et al. | 428/76 |
| D663,076 | S * | 7/2012 | Parsons | D29/122 |
| D670,870 | S * | 11/2012 | Harris | D29/122 |
| 8,359,770 | B2 | 1/2013 | Frederick | |
| D679,058 | S * | 3/2013 | Szalkowski | D29/122 |
| 2002/0104150 | A1 * | 8/2002 | Hill | 2/174 |
| 2002/0120978 | A1 * | 9/2002 | Moore, III | A42B 3/125 2/412 |
| 2004/0107482 | A1 * | 6/2004 | Picotte | 2/411 |
| 2004/0226077 | A1 * | 11/2004 | Toth | 2/411 |
| 2008/0172779 | A1 * | 7/2008 | Ferguson | 2/455 |
| 2009/0222975 | A1 * | 9/2009 | Green et al. | 2/410 |
| 2012/0084896 | A1 * | 4/2012 | Wyner et al. | 2/16 |
| 2012/0151664 | A1 * | 6/2012 | Kirshon | 2/413 |
| 2013/0000017 | A1 * | 1/2013 | Szalkowski et al. | 2/414 |
| 2013/0086733 | A1 * | 4/2013 | Szalkowski | A42B 3/12 2/414 |
| 2014/0020158 | A1 * | 1/2014 | Parsons et al. | 2/413 |

* cited by examiner

*Primary Examiner* — Amy Vanatta
(74) *Attorney, Agent, or Firm* — Lewis Roca Rothgerber Christie LLP

(57) ABSTRACT

A helmet liner and a helmet assembly including a liner. A helmet liner includes a plurality of panels, each of the plurality of panels coupled to and foldable relative to at least one other panel of the plurality of panels at a seam, each of the panels including a gel layer.

14 Claims, 5 Drawing Sheets

COMPARISON OF BULLET PROOF MATERIAL AND BULLET PROOF MATERIAL WITH GEL LAYER

HELMET LINER

FIELD

Aspects of embodiments of the present invention relate to a helmet liner, and a helmet assembly including a liner.

BACKGROUND

Protective helmets are commonly used in military, sports, and construction environments in order to protect a head of a user from brain injuries, concussions, and other head injuries. However, typical helmets, though useful in protecting against penetration of sharp objects, may not be effective in absorbing impact and blunt trauma forces, vibration, sound, percussion energy, and other forces which may otherwise injure the user's head. Further, typical hard-shell helmets that do not have cushioning or absorption properties do not provide protection against head impact acceleration and severe force on the brain. As such, there is a need for a helmet that can prevent or reduce brain injuries, concussions, and other head injuries that may be caused by these environmental factors.

SUMMARY

According to an aspect of embodiments of the present invention, a helmet liner, or helmet insert, is insertable in and attachable to an inside of a helmet or similar headgear to absorb and protect a user against vibration, sound, percussion energy, and other forces which may otherwise injure the user.

According to another aspect of embodiments of the present invention, a helmet or similar headgear includes a liner, or insert, on an inside of the helmet to be positioned between the helmet and a user's head to absorb and protect the user against vibration, sound, percussion energy, concussive forces, and other forces which may otherwise injure the user.

According to another aspect of embodiments of the present invention, a helmet liner includes a gel layer configured to absorb vibration, sound, percussion energy, concussive forces, and other forces. As such, the helmet liner may absorb impact and blunt trauma forces, and thereby prevent or reduce brain injuries, concussions, skull fracture, and other head injuries.

According to another aspect of embodiments of the present invention, a helmet liner includes a gel layer configured to mimic a body temperature of the wearer, and having vibration and force absorption properties which do not deteriorate over time.

According to another aspect of embodiments of the present invention, a helmet liner includes a plurality of panels, each including a gel layer, such that the helmet liner may conform to a shape of a user's head and to different user's heads. That is, the helmet liner may "form fit" to an exact shape of a user's head by merely placing a helmet including the helmet liner on the user's head.

According to one or more embodiments of the present invention, a helmet liner includes a plurality of panels, each of the plurality of panels coupled to and foldable relative to at least one other panel of the plurality of panels at a seam, each of the panels including a gel layer.

The gel layer may be configured to absorb and dissipate energy from vibration and percussion waves. In one embodiment, the gel layer includes polyurethane and a catalyst.

The gel layer may have a thickness of approximately 3/8 inch. The gel layer may be configured to provide a sound pressure level reduction of at least approximately 166 decibels.

The seam may include a radio frequency welded seam.

Each of the panels may further include: a back layer on a first side of the gel layer, the back layer comprising vinyl; and a front layer on a second side of the gel layer opposite the first layer, the front layer including a wicking RF-weldable material.

The plurality of panels may include: at least one front panel; at least one central panel coupled to and foldable relative to the at least one front panel; and at least one rear panel coupled to and foldable relative to the at least one central panel.

In one embodiment, the at least one front panel includes at least one first front panel, and second front panels coupled to opposite sides of the at least one first front panel and foldable relative to the at least one first front panel, the at least one central panel includes at least one first central panel, and second central panels coupled to opposite sides of the at least one first central panel and foldable relative to the at least one first central panel, and the at least one rear panel includes at least one first rear panel, and second rear panels coupled to opposite sides of the at least one first rear panel and foldable relative to the at least one first rear panel. The at least one first central panel may include a plurality of first central panels.

According to another embodiment of the present invention, a helmet assembly includes: a helmet including an outer surface, and an inner surface opposite the outer surface and defining a cavity of the helmet; and a helmet liner attached to the inner surface of the helmet and including a plurality of panels, each of the plurality of panels coupled to and folded relative to at least one other panel of the plurality of panels at a seam, each of the panels including a gel layer.

BRIEF DESCRIPTION OF THE DRAWINGS

The above and other features, aspects, and advantages of the present invention will become better understood with regard to the following description, appended claims, and accompanying drawings where:

DETAILED DESCRIPTION

In the following detailed description, certain exemplary embodiments of the present invention are shown and described, by way of illustration. As those skilled in the art would recognize, the described exemplary embodiments may be modified in various ways without departing from the spirit and scope of the present invention. Accordingly, the drawings and description are to be regarded as illustrative in nature, rather than restrictive.

As used herein, the term "helmet" is not intended to be limiting and is used to include, for example, helmets to be worn by soldiers, helmets to be used in sports and recreation activities, and other protective headgear, such as hard hats or helmets used in construction or other activities that may potentially result in an injury to the head. Also, as used herein, the term "liner" is not intended to be limiting and is used to include a liner, an insert, or a similar device or structure to be arranged in a cavity of a helmet.

Figure 1:
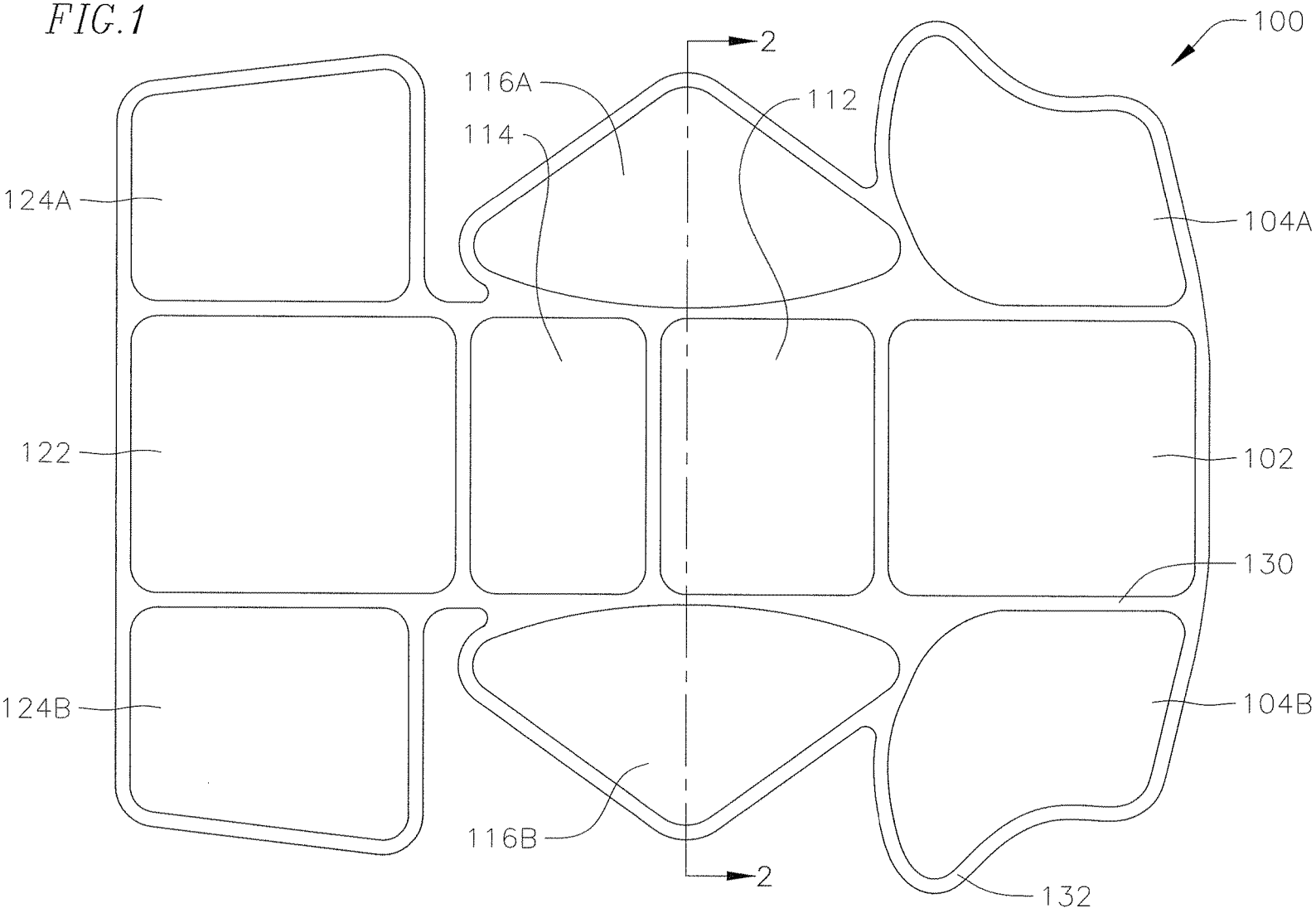
FIG. 1 is a top view of a helmet liner according to an embodiment of the present invention, the helmet liner being shown in an unfolded state.
Figure 2:
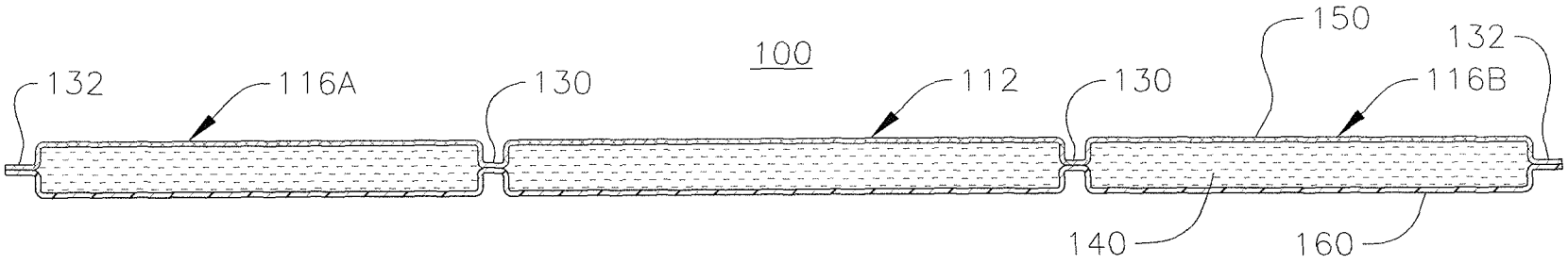
FIG. 2 is a cross-sectional view of the helmet liner of FIG. 1, the helmet liner being shown in an unfolded state.

With reference to FIGS. 1 and 2, a helmet liner 100 according to an embodiment of the present invention includes a plurality of panels, each coupled to and foldable relative to at least one other of the panels at a seam 130, each of the panels comprising a gel layer 140. The panels may be configured and positioned relative to one another to provide a snug fit around a user's head when the panels are arranged in a cavity of a helmet in a folded state. The panels of the helmet liner 100 are shown in FIG. 1 in an unfolded state. In one embodiment, as shown in FIG. 1, the helmet liner 100 includes ten of the panels. However, the present invention is not limited thereto, and, in other embodiments, the number of panels may be varied.

In one embodiment, the helmet liner 100 includes a first front panel 102 and second front panels 104A, 104B at opposite sides of the first front panel 102. Each of the second front panels 104A, 104B is coupled to and foldable relative to the first front panel 102 at the seam 130. The helmet liner 100, in one embodiment, further includes a pair of first central panels 112 and 114, and second central panels 116A, 116B at opposite sides of the pair of first central panels 112 and 114. The first central panels 112 and 114 are coupled to and foldable relative to each other, and each of the second central panels 116A, 116B is coupled to and foldable relative to the first central panels 112 and 114 at the seam 130. Further, the first central panel 112 is coupled to and foldable relative to the first front panel 102 at the seam 130, and the second central panels 116A, 116B may be coupled to and foldable relative to the second front panels 104A, 104B at the seam 130. The helmet liner 100, in one embodiment, includes a first rear panel 122 and second rear panels 124A, 124B at opposite sides of the first rear panel 122. Each of the second rear panels 124A, 124B is coupled to and foldable relative to the first rear panel 122 at the seam 130. Further, the first rear panel 122 is coupled to and foldable relative to the first central panel 114 at the seam 130. The helmet liner 100, in one embodiment, further includes an exterior seam 132 around a periphery of the helmet liner 100.

In one embodiment, as shown in FIG. 2, the helmet liner 100 includes the gel layer 140, a back layer 150 on a first side of the gel layer 140, and a front layer 160 on a second side of the gel layer 140 opposite the first side. The gel layer 140 is configured to absorb and dissipate energy from percussion waves (e.g., from an explosive device), concussive forces, and vibration. The gel layer 140, in one embodiment, includes a polyurethane and a catalyst. Further, in one embodiment, the gel layer 140 is made up of the gel known as MITgel available from MITgel, Olympia, Wash. In one embodiment, the gel layer 140 has a thickness of approximately ⅜ inch. In one embodiment in which the gel layer 140 has a thickness of ⅜ inch, the gel layer 140 has a noise reduction rating (NRR) or sound pressure level (SPL) reduction of approximately 166 decibels ("dBs") (i.e. the intensity of a sound pressure wave will be reduced by approximately 166 dBs after passing through a ⅜ inch thick gel layer 140). However, the present invention is not limited thereto, and, in another embodiment, for example, the gel layer 140 may have a thickness of approximately ¼ inch to approximately ½ inch, and may have an SPL reduction of greater than 166 dBs, depending on the thickness of the gel layer 140. The gel layer 140 may have a high chemical resistivity to a variety of chemicals, including hydrocarbons and acids. In one embodiment, the gel layer 140 may have a melting point of approximately 850° F. and a freezing point of approximately −150° F., and is configured to maintain a gel-like consistency between approximately −150° F. and 850° F.). The gel layer 140 may be flash-flame proof and configured to withstand 0 Kelvin. The gel layer 140 is configured to act as a thermal insulator (i.e. the gel layer 140 has a low thermal conductivity). Further, the gel layer 140 may be configured to quickly match a temperature of an object that it contacts. The gel layer 140 may be configured to be "self-healing" such that the gel flows into any areas damaged (i.e. the gel is configured to fill any voids). The gel layer 140, in one embodiment, is configured to maintain its adhesive properties to approximately 185° F. The gel layer 140 is also anti-bacterial and inert to the human anatomy, and may also be gas impermeable.

The back layer 150, in one embodiment, is made of vinyl having a thickness of approximately 20 mils. The front layer 160, in one embodiment, is made of a wicking, radio frequency (RF) weldable material. The wicking material, in one embodiment, may be made of polyester having a thickness of approximately 6 mils and is configured to displace moisture from a user's head. Further, the polyester may be blistered on a back side that is RF-welded to the back layer 150. However, the present invention is not limited to the above-described material and thicknesses. For example, in other embodiments, the back layer 150 and the front layer 160 may be made of any other suitable material or combination of materials having a suitable thickness. In one embodiment, as depicted in FIG. 2, the front layer 160 is attached (e.g., RF welded) to the back layer 150 at each of the seams 130 and the exterior seams 132. Each of the panels of the helmet liner 100 described above and shown in FIG. 1 may have a three-layer structure as shown in FIG. 2. However, the present invention is not limited thereto, and, in other embodiments, one or more additional layers may be present.

Figure 3:
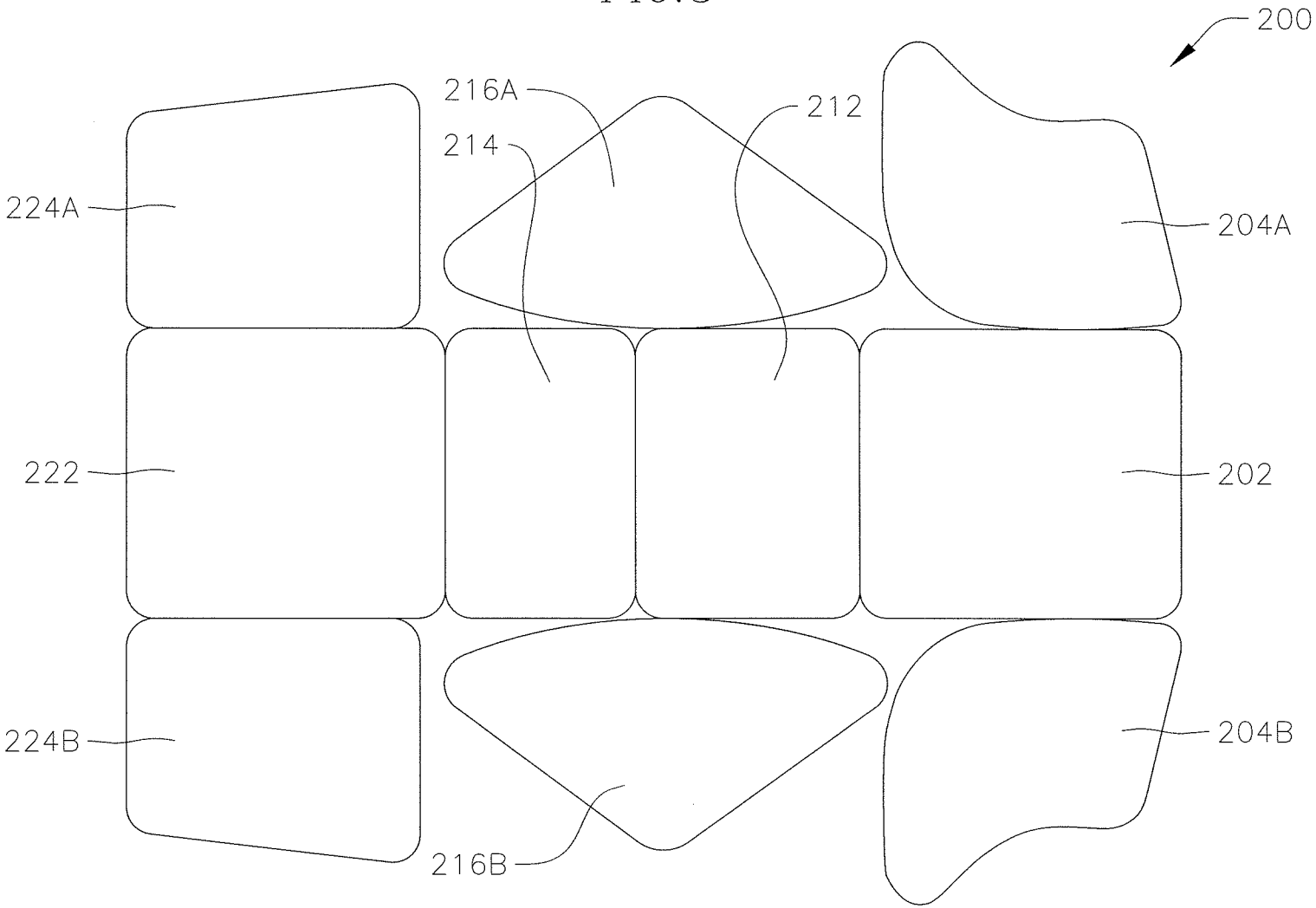
FIG. 3 is a top view of a helmet liner according to another embodiment of the present invention, the helmet liner being shown in an unfolded state.

With reference to FIG. 3, a helmet liner 200 according to another embodiment of the present invention has a configuration similar to that of the helmet liner 100 described above and shown in FIG. 1. The helmet liner 200 includes a plurality of panels each coupled to and foldable relative to at least one other of the panels, each of the panels comprising the gel layer 140 described above. The panels may be configured and positioned relative to one another to provide a snug fit around a user's head when the panels are arranged in a cavity of a helmet in a folded state. The panels of the helmet liner 200 are shown in FIG. 3 in an unfolded state. In one embodiment, as shown in FIG. 3, the helmet liner 200 includes ten of the panels. However, the present invention is not limited thereto, and, in other embodiments, the number of panels may be varied.

In one embodiment, the helmet liner 200 includes a first front panel 202 and second front panels 204A, 204B at opposite sides of the first front panel 202. Each of the second front panels 204A, 204B is coupled to and foldable relative to the first front panel 202. The helmet liner 200, in one embodiment, further includes a pair of first central panels 212 and 214, and second central panels 216A, 216B at opposite sides of the pair of first central panels 212 and 214. The first central panels 212 and 214 are coupled to and foldable relative to each other, and each of the second panels 216A, 216B is coupled to and foldable relative to the first central panels 212 and 214. Further, the first central panel 212 is coupled to and foldable relative to the first front panel 202. The helmet liner 200 differs from the helmet liner 100 described above in that the second central panels 216A, 216B are spaced apart from the second front panels 204A, 204B, rather than being coupled directly to one another at a seam. As such, folding of the helmet liner 200 to have a desired configuration may be facilitated. The helmet liner 200, in one embodiment, includes a first rear panel 222 and second rear panels 224A, 224B at opposite sides of the first rear panel 222. Each of the second rear panels 224A, 224B is coupled to and foldable relative to the first rear panel 222. Further, the first rear panel 222 is coupled to and foldable relative to the first central panel 214. Although not depicted in the drawing, the helmet liner 200, similar to the helmet liner 100 described above, may include one or more seams (e.g., RF-welded seams) at which the panels are coupled to and foldable relative to one another, and also an exterior seam around a periphery of the helmet liner 200. Also, the helmet liner 200 may have a cross-sectional configuration similar to that of the helmet liner 100 described above with respect to FIG. 2.

Figure 4:
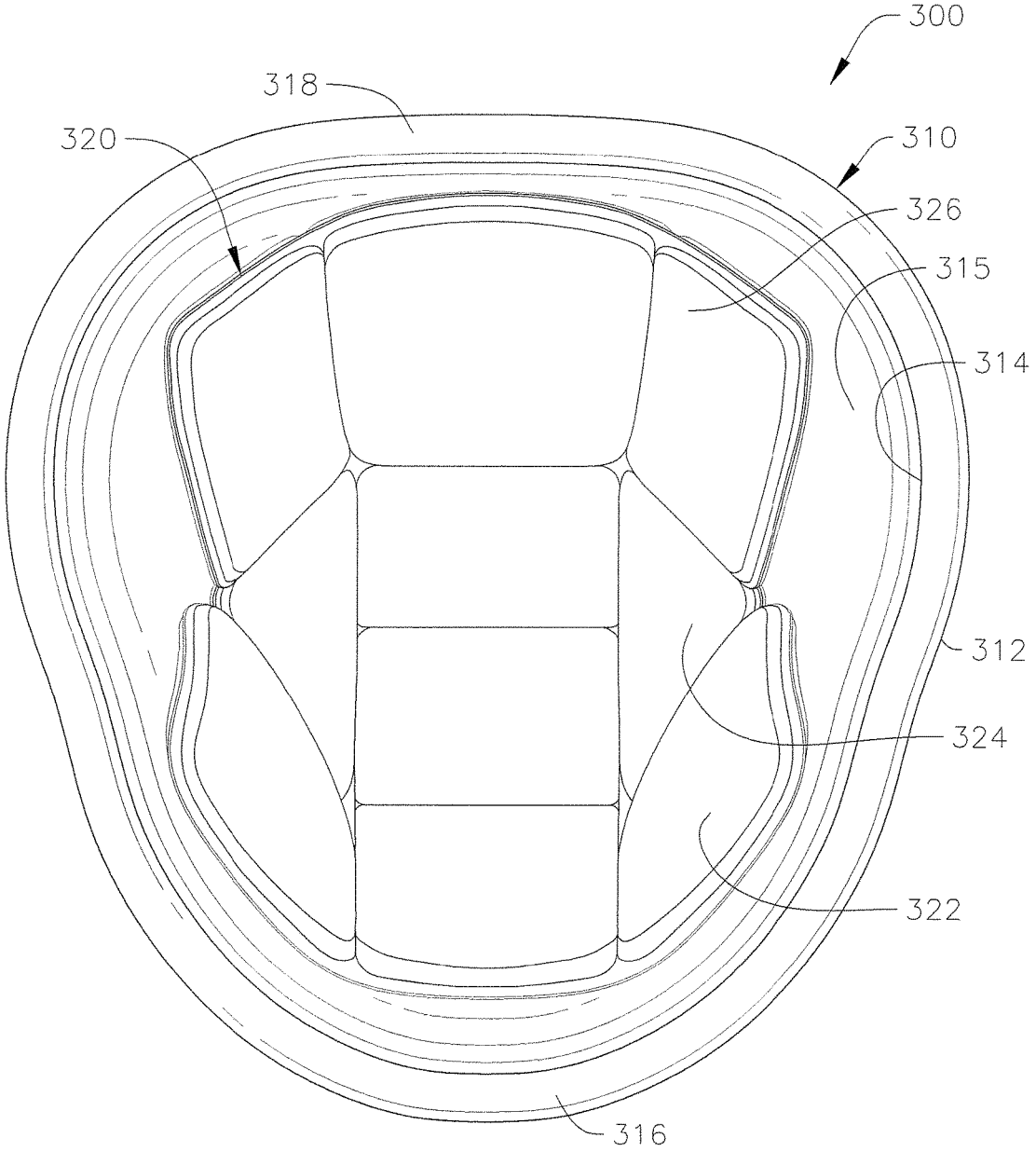
FIG. 4 is a perspective view of a helmet assembly according to an embodiment of the present invention.

With reference to FIG. 4, a helmet assembly 300 according to an embodiment of the present invention includes a helmet 310, and a helmet liner 320 arranged in a cavity 315 of the helmet 310. The helmet 310 includes an outer surface 312, an inner surface 314, and the cavity 315 adjacent the inner surface 314. The helmet liner 320 is arranged in the cavity 315 and may be attached to the inner surface 314, such as via an adhesive, one or more fasteners, a hook-and-loop type fastener, or any other suitable device or method. The helmet liner 320 is arranged in a folded state within the cavity 315 of the helmet 310. In one embodiment, the helmet liner 320 may have a same or substantially same configuration as the helmet liner 100 or the helmet liner 200 described above. That is, in one embodiment, the helmet liner 320 includes a plurality of front panels 322 arranged adjacent a front portion 316 of the helmet 310, and the front panels 322 are coupled to and folded relative to each other at a seam. Further, in one embodiment, the helmet liner 320 includes a plurality of central panels 324 arranged at a central portion of the helmet 310, and the central panels 324 are coupled to and folded relative to each other at a seam, and also coupled to and folded relative to the front panels 322. Further, in one embodiment, the helmet liner 320 includes a plurality of rear panels 326 arranged adjacent a rear portion 318 of the helmet 310, and the rear panels 326 are coupled to and folded relative to each other at a seam, and also coupled to and folded relative to the central panels 324.

According to embodiments of the present invention, the helmet assembly 300 including the helmet liner 320 including the plurality of panels and the gel layer is configured to conform to a shape of a user's head and provide a "form fit" to an exact shape of a user's head by merely placing the helmet assembly 300 on the user's head. The helmet assembly 300 is configured to absorb vibration, sound, percussion energy, concussive forces, and other forces, and, as such, the helmet assembly may thereby prevent or reduce brain injuries, concussions, skull fracture, and other head injuries. Additionally, the helmet assembly 300 according to embodiments of the present invention includes the gel layer which is configured to mimic a body temperature of the wearer, and has vibration and force absorption properties which do not deteriorate over time. Further, the helmet assembly 300 is configured to absorb all types of wave energy, including sound waves, percussion waves, and back noise energy, from every angle within a 360-degree radius and from above. Further, the helmet liner 320 may be assembled into the helmet 310 as a one-piece unit, such that optimal placement of the helmet liner 320 may be easily achieved for increased reduction of concussive forces to the user's head.

Figure 5:
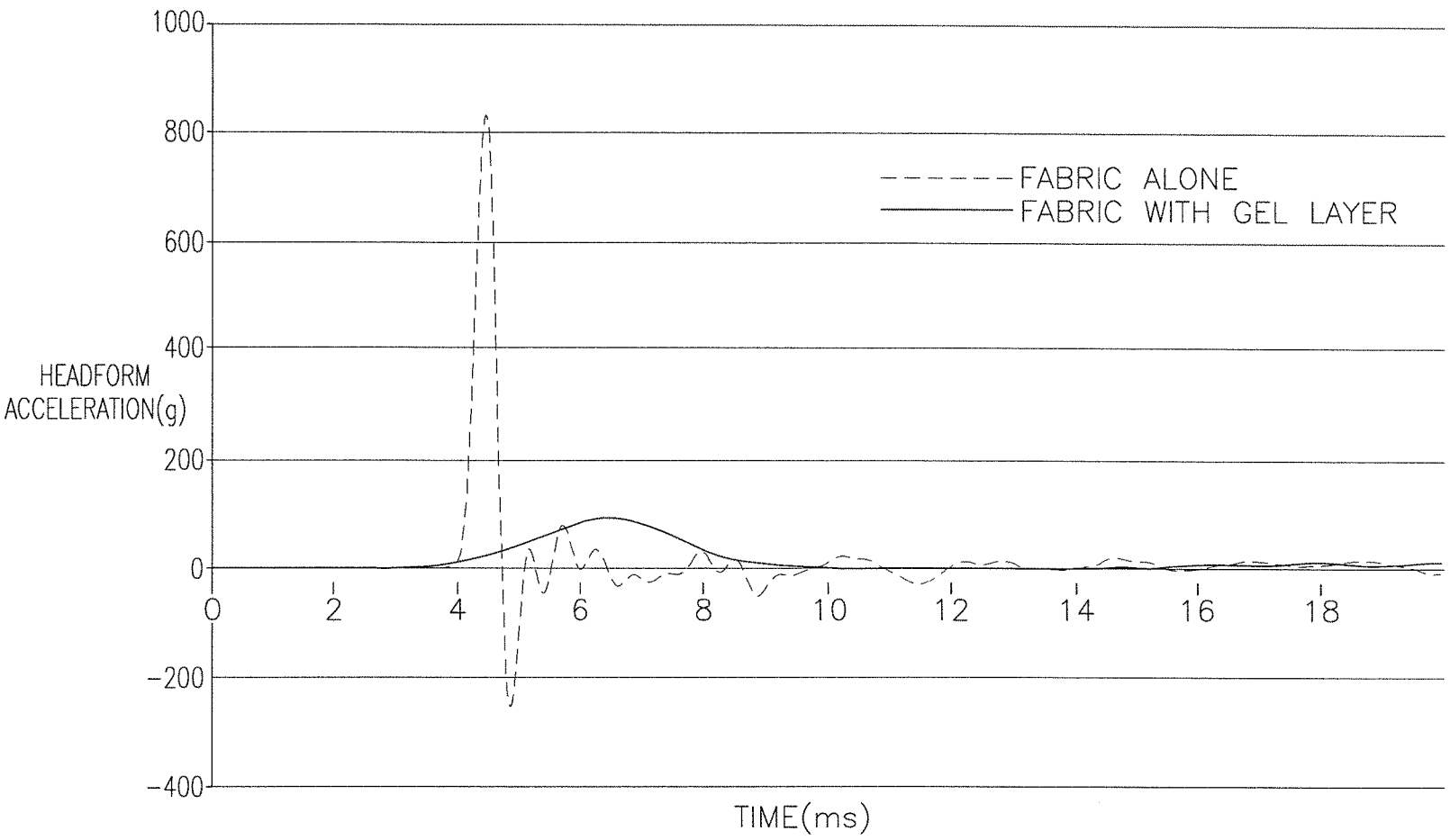
FIG. 5 is a comparative chart illustrating test results of a bullet proof material including a gel layer.

FIG. 5 is a comparative chart illustrating test results of a bullet proof material including a gel layer. More specifically, FIG. 5 shows a comparison in a reduction of force from a ballistic impact between a bullet proof material of fabric alone and a bullet proof material of fabric with a gel layer, such as a gel layer having a same composition and thickness as the gel layer 140 of the helmet liner 100 or a gel layer of the helmet liner 320 described above. As shown in FIG. 5, in the bullet proof material of fabric alone, a headform acceleration reached 829 G at a moment of impact, whereas in the bullet proof material of fabric with the gel layer, a headform acceleration was only 22 G at a moment of impact, and reached a maximum of only 90 G after 2 ms. The test results demonstrate the absorptive property of the gel layer of the present invention for providing a reduction of force, such as a concussive force against a helmet.

Although the drawings and accompanying description illustrate some exemplary embodiments of a transmission line monitor and a method of monitoring a transmission line using the same, it will be apparent that the novel aspects of the present invention may also be carried out by utilizing alternative structures, sizes, shapes, and/or materials in embodiments of the present invention. Also, in other embodiments, components described above with respect to one embodiment may be included together with or interchanged with those of other embodiments.

The preceding description has been presented with reference to certain embodiments of the invention. Persons skilled in the art and technology to which this invention pertains will appreciate that alterations and changes in the described structures and methods of operation can be practiced without meaningfully departing from the principles, spirit, and scope of this invention.

What is claimed is:

1. A helmet insert comprising a plurality of sections, each of the plurality of sections coupled to and foldable relative to at least one other section of the plurality of sections, each of the sections comprising a polyurethane gel layer having a thickness of approximately ⅜ inch and a generally same perimeter size as the respective section, the polyurethane gel layer of each of the sections being an uninterrupted layer surrounded and separated from the polyurethane gel layer of an adjacent section of the plurality of sections by a seam, wherein the plurality of sections comprises:

at least one front section;

at least one central section coupled to and foldable relative to the at least one front section; and at least one rear section coupled to and foldable relative to the at least one central section, wherein the at least one front section comprises at least one first front section, and second front sections adjacent and coupled to opposite sides of the at least one first front section and foldable relative to the at least one first front section, wherein the at least one central section comprises two first central sections, and second central sections coupled to opposite sides of the two first central sections and foldable relative to the two first central sections, wherein the at least one rear section comprises at least one first rear section, and second rear sections adjacent and coupled to opposite sides of the at least one first rear section and foldable relative to the at least one first rear section, and wherein the first front section is adjacent and coupled to one of the two first central sections, and the first rear section is adjacent and coupled to the other of the two first central sections.

2. The helmet insert of claim 1, wherein the polyurethane gel layer is configured to absorb and dissipate energy from vibration and percussion waves.

3. The helmet insert of claim 1, wherein the polyurethane gel layer comprises a catalyst.

4. The helmet insert of claim 1, wherein the entire polyurethane gel layer has the thickness of approximately ⅜ inch.

5. The helmet insert of claim 1, wherein the polyurethane gel layer is configured to provide a sound pressure level reduction of at least approximately 166 decibels.

6. The helmet insert of claim 1, wherein the seam comprises a radio frequency welded seam.

7. The helmet insert of claim 1, wherein each of the sections further comprises:

a back layer on a first side of the polyurethane gel layer, the back layer comprising vinyl; and a front layer on a second side of the polyurethane gel layer opposite the first side, the front layer comprising a wicking RF-weldable material.

8. A helmet assembly comprising:

a helmet comprising an outer surface, and an inner surface opposite the outer surface and defining a cavity of the helmet;

a helmet insert attached to the inner surface of the helmet and comprising a plurality of sections, each of the plurality of sections coupled to and folded relative to at least one other section of the plurality of sections, each of the sections comprising a polyurethane gel layer having a thickness of approximately ⅜ inch and a generally same perimeter size as the respective section, the polyurethane gel layer of each of the sections being an uninterrupted layer surrounded and separated from the polyurethane gel layer of an adjacent section of the plurality of sections by a seam, wherein the plurality of sections comprises:

at least one front section;

at least one central section coupled to and foldable relative to the at least one front section; and at least one rear section coupled to and foldable relative to the at least one central section, wherein the at least one front section comprises at least one first front section, and second front sections adjacent and coupled to opposite sides of the at least one first front section and foldable relative to the at least one first front section, wherein the at least one central section comprises two first central sections, and second central sections coupled to opposite sides of the two first central sections and foldable relative to the two first central sections, wherein the at least one rear section comprises at least one first rear section, and second rear sections adjacent and coupled to opposite sides of the at least one first rear section and foldable relative to the at least one first rear section, and wherein the first front section is adjacent and coupled to one of the two first central sections, and the first rear section is adjacent and coupled to the other of the two first central sections.

9. The helmet assembly of claim 8, wherein the polyurethane gel layer is configured to absorb and dissipate energy from vibration and percussion waves.

10. The helmet assembly of claim 8, wherein the polyurethane gel layer comprises a catalyst.

11. The helmet assembly of claim 8, wherein the entire polyurethane gel layer has the thickness of approximately ⅜ inch.

12. The helmet assembly of claim 8, wherein the polyurethane gel layer is configured to provide a sound pressure level reduction of at least approximately 166 decibels.

13. The helmet assembly of claim 8, wherein the seam comprises a radio frequency welded seam.

14. The helmet assembly of claim 8, wherein each of the sections further comprises:

a back layer on a first side of the polyurethane gel layer, the back layer comprising vinyl; and a front layer on a second side of the polyurethane gel layer opposite the first side, the front layer comprising a wicking RF-weldable material.

* * * * *